US005543772A

United States Patent [19]

Ruppmann et al.

[11] Patent Number: 5,543,772

[45] Date of Patent: Aug. 6, 1996

[54] HIGH VOLTAGE CONNECTION TO IGNITION COILS

[75] Inventors: Claus Ruppmann, late of Farmington Hills, Mich.; Andreas Ehrmann, Schorndorf, Germany; Alexander Bareiss, North Charleston, S.C.

[73] Assignee: Robert Bosch GmbH, Stuttgart, Germany

[21] Appl. No.: 988,968

[22] PCT Filed: Sep. 6, 1991

[86] PCT No.: PCT/DE91/00710

§ 371 Date: Dec. 23, 1993

§ 102(e) Date: Dec. 23, 1993

[87] PCT Pub. No.: WO92/07370

PCT Pub. Date: Apr. 30, 1992

[30] Foreign Application Priority Data

Oct. 11, 1990 [DE] Germany ..... 40 32 280.7

[51] Int. Cl.[6] ..... H01F 27/04

[52] U.S. Cl. ..... 336/192; 336/107; 336/96

[58] Field of Search ..... 336/107, 96, 192

[56] References Cited

U.S. PATENT DOCUMENTS

| | | | |
|---|---|---|---|
| 2,930,011 | 3/1960 | Wigert et al. | 336/96 |
| 4,161,776 | 7/1979 | Onoue | 363/146 |
| 4,408,176 | 10/1983 | Nakamura et al. | 336/107 |
| 4,587,942 | 5/1986 | Burson | 123/599 |
| 4,683,454 | 7/1987 | Vollmer et al. | 335/299 |
| 4,740,773 | 4/1988 | Buchschmid et al. | 336/96 |
| 4,931,728 | 6/1990 | Hata et al. | 324/207.15 |

FOREIGN PATENT DOCUMENTS 1140706 1/1989 Japan .

*Primary Examiner*—Laura Thomas
*Attorney, Agent, or Firm*—Michael J. Striker

[57] ABSTRACT

The ignition coil includes a cast resin portion; a primary winding embedded in the cast resin portion; a secondary winding embedded in the cast resin portion; at least one contact part electrically connecting an end portion of an ignition cable and a high-voltage end of the secondary winding; a retaining part (4) having a throughgoing aperture for receiving the ignition cable (2), the retaining part (4) protruding from the cast resin portion (14); a shrink hose (3) acting as a sealing means surrounding the end portion of the ignition cable (2) concentrically, extending through the aperture of the retaining part (4) and beyond the retaining part (4); and a shrink sleeve (6) acting as additional sealing means concentric with the end portion of the ignition cable (2) and connected with the end portion of the ignition cable at least in one end region and with the retaining part (4) at least in another end region thereof so as to seal against moisture.

4 Claims, 1 Drawing Sheet

HIGH VOLTAGE CONNECTION TO IGNITION COILS

BACKGROUND OF THE INVENTION

The present invention relates to ignition coils, and, more particularly, to ignition coils having a high-voltage connection device or means for connecting an ignition cable to a secondary winding of the ignition coil.

An ignition coil is known, comprising a primary winding embedded in a cast resin portion, a secondary winding embedded in the cast resin portion and a high-voltage electrical connection device. The high-voltage electrical connection device includes at least one contact part electrically connecting a high-voltage end of the secondary coil to a conducting end portion of an ignition cable and a retaining part protruding beyond the cast resin portion and provided with a throughgoing aperture. A high-voltage connection of an ignition cable to an ignition coil is known from the DE-OS 35 06 929, in which the ignition cable end is introduced into an aperture of a connection tower and contacted by a pointed contact pin, with the contact pin being electrically connected via a contact wire to the end of a high-voltage winding. The connection tower, into which the ignition cable is inserted, is sealed against moisture by a shroud.

It is further common practice to use plug-type contacts for the connection of the high-voltage cable to the high-voltage winding. These plug-type contacts may be insulating plastic molded pieces. Such plastic molded pieces do not always guarantee a low-loss transmission, particularly with extremely high voltages, where moisture has penetrated, for example. In order to ensure safe handling of the high voltage, the plastic molded pieces would need to be of larger dimension. However, that would have the disadvantage that the connection area would have significantly larger dimensions and that the weight of the ignition unit would also increase.

The aim is to develop a high-voltage connection which removes this disadvantage and ensures, with the minimum weight possible, a low-loss transmission of the high voltage from the ignition coil to the ignition cable.

SUMMARY OF THE INVENTION

It is an object of the present invention to provide an ignition coil having an improved high-voltage connection device for connecting the secondary winding to at least one ignition cable.

According to the invention, the ignition coil comprises a cast resin portion; a primary winding embedded in the cast resin portion; a secondary winding embedded in the cast resin portion; at least one contact part electrically connecting the high-voltage end of the secondary coil to a conducting end portion of an ignition cable; a retaining part having a throughgoing aperture for receiving the ignition cable, the retaining part protruding from the cast resin portion; a shrink hose acting as a sealing means surrounding the end portion of the ignition cable concentrically, extending through the aperture of the retaining part and beyond the retaining part; and a shrink sleeve acting as additional sealing means concentric with the end portion of the ignition cable and connected with the end portion of the ignition cable at least in one end region thereof and with the retaining part at least in another end region thereof so as to seal against moisture.

In contrast, the ignition system in accordance with the invention has the advantage that the high-voltage connection has small dimensions and hence a low weight and that the electrical point well protected against moisture by multiple overlapping of various components.

Various embodiments of the above-described ignition coil according to the invention are possible. Of particular advantages is the preferred embodiment in which a cast resin/air/cable transition region is replaced by a cast resin/retaining part/cable transition region. Since the flexible ignition cable does not therefore directly emerge from the casting compound, the mechanical load is low at this point.

BRIEF DESCRIPTION OF THE DRAWING

The objects, features and advantages of the present invention will now be illustrated in more detail by the following detailed description, reference being made to the accompanying drawing in which.

DETAILED DESCRIPTION OF THE PREFERRED EMBODIMENT

Figure 1:
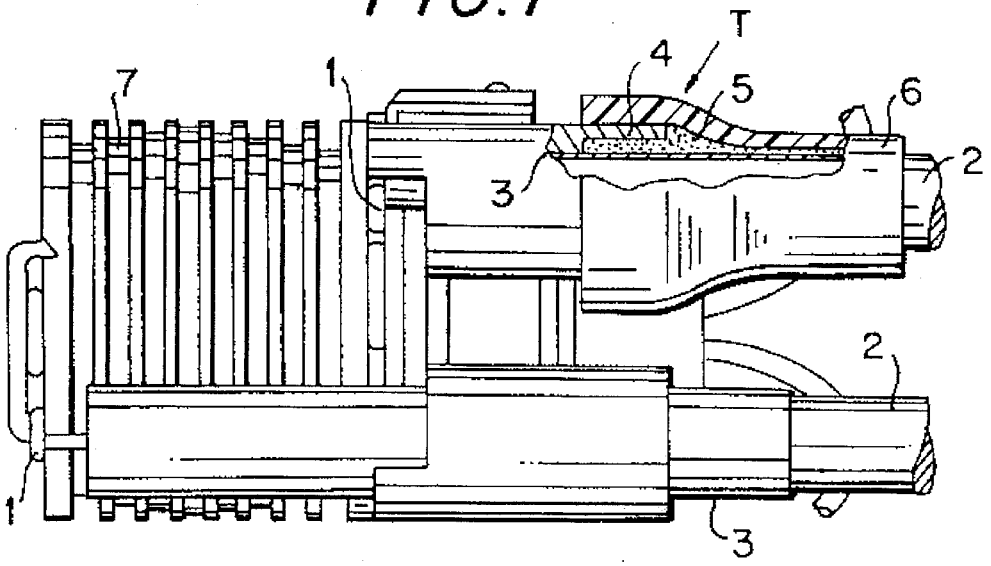
FIG. 1 is a partially side elevational, partially cross-sectional view of an ignition coil secondary winding with an improved high-voltage connection means for an ignition cable according to the invention.
Figure 2:
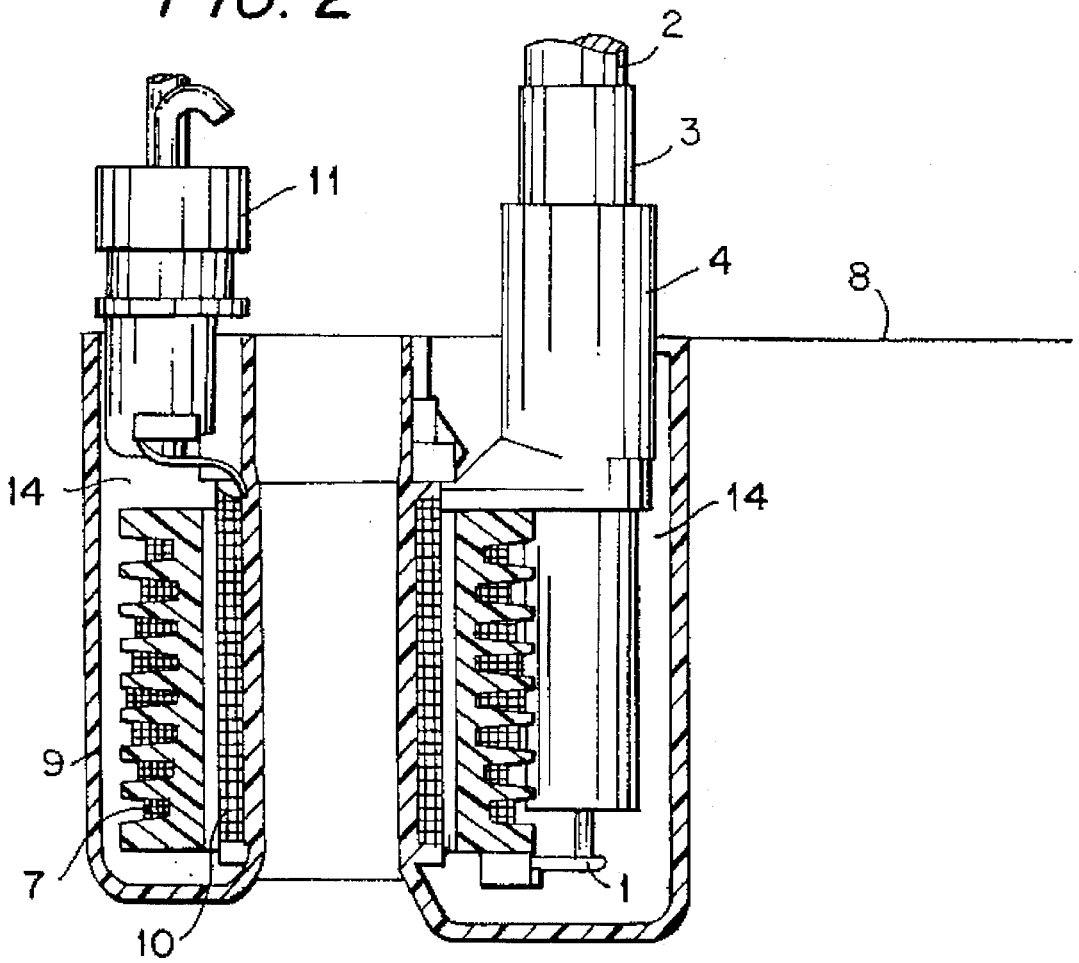
FIG. 2 is a cross-sectional view of the ignition coil of FIG. 1 in a housing.

FIGS. 1 and 2 show details of the ignition coil of an ignition system with a secondary winding 7 arranged in a housing 9, and primary winding 10. A contact part 1 at the two high-voltage winding ends of the secondary winding 7 is conductively connected to an ignition cable 2, with a shrink hose 3 being pulled over the ignition cable end, for the better bonding of ignition cable and cast resin. The ignition cable 2 with the shrink hose 3 is held in a retaining part 4, with the transition point T being sealed by an adhesive 5 and the ignition cable 2, which protrudes from the ignition coil, being covered by an additional shrink sleeve part 6 at the transition point T. FIG. 2, in addition to a primary connection 11, again shows the connection point of contact part 1 and the ignition cable 2, and the level 8 of a cast resin portion 14 is indicated, up to which the housing 9 of the ignition coil is filled with curable cast resin.

The high-voltage connection means 3,4,6 shown in FIG. 1 is more explained in more detail in the following. Each of the contact parts 1 of the secondary winding 7 is conductively and mechanically firmly connected to one of the ignition cables 2. The ignition cable end is located within the ignition coil in the cast resin portion 14 which is cast into the ignition coil. Owing to the peculiarities of the material, the resin and the ignition cable bond only very poorly to each other. In order to avoid leakage current, the shrink hose 3 is pulled over the ignition cable end. This shrink hose 3 has the characteristic that it bonds better with the resin to the outside, and, due to its sticky-like surface, it forms a moisture sealing connection to the inside with the ignition cable. Without any additional provision, the ignition cable would be severely mechanically stressed at the transition point T of the resin/air/cable. This would occur, since the ignition cable is immovably embedded in the resin but is movable at the point of emergence from the resin, i.e. there is the risk that the ignition cable can separate from the resin. To avoid this, the ends of the ignition cable with the shrink hose 3 are pushed through corresponding apertures of the plastic retaining part 4, before they are connected at the contact parts 1 to the secondary winding 10. The unit in accordance with FIG. 1 thus obtained is then inserted into the housing 9 shown in FIG. 2, with the retaining part 4 protruding slightly from the cast resin and the transition point of cast resin/air/cable transformed into the transition point of cast resin/retaining part/cable. This retaining part 4 thus takes on the mechanical function of the previously commonly employed plug-type contact, but it has the advantage that its dimensions are much smaller. In order to protect this transition point T from moisture or contamination, for example, it is sealed by an adhesive 5 in such a way that the adhesive extends, starting from the ignition cable, via the shrink hose 3 and into the retaining part 4—into the gap between the inner wall of the aperture in the retaining part 4 and the outer wall of the shrink hose 3 pulled onto the ignition cable 2—up to the resin level. To provide additional sealing, one of the ends of the shrink sleeve part 6 is then pushed over the end of the retaining part 4 which protrudes from the resin while, its other end rests against the ignition cable 2 and is fixed to these parts so as to seal against moisture by the adhesive 5. The various connection parts, such as shrink hose, retaining part, and shrink hose, overlap at their transition points.

In this way, a high-voltage resistant transition between the high-voltage winding and the ignition cable is formed which is further characterized by its small size and light weight.

While the invention has been illustrated and embodied in an ignition coil with a high-voltage connection device for connecting a secondary winding to at least one ignition cable, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

We claim:

1. Ignition coil comprising a cast resin portion; a primary winding embedded in said cast resin portion; a secondary winding embedded in said cast resin portion; at least one contact part electrically connected to an end portion of an ignition cable and to a high-voltage end of the secondary winding; a retaining part (4) having a throughgoing aperture for receiving said ignition cable (2), said retaining part (4) protruding from said cast resin portion (14); a shrink hose (3) acting as a sealing means surrounding said end portion of said ignition cable (2) concentrically, extending through said aperture of said retaining part (4) and beyond said retaining part (4); and a shrink sleeve (6) acting as additional sealing means concentric with said end portion of said ignition cable (2) and connected at least in one end region with said end portion of said ignition cable and with said retaining part (4) at least in another end region so as to seal against moisture.

2. Ignition coil as defined in claim 1, further comprising an adhesive portion (5) acting as a further sealing means, said adhesive portion extending through an annular gap between said shrink hose (3) and said shrink sleeve (6) up to said cast resin portion (14).

3. Ignition coil as defined in claim 2, wherein said other end region of said shrink sleeve (6) is pulled over said retaining part (4) and said end regions of said shrink sleeve (6) are fixed to said retaining part (4) and said ignition cable (2) by said adhesive means (5).

4. Ignition coil as defined in claim 3, wherein a central portion of said shrink sleeve (6) covers an end section of said shrink hose (3) protruding from said retaining part (4).

* * * * *